US005495628A

United States Patent [19]

Logan

[11] Patent Number: 5,495,628

[45] Date of Patent: Mar. 5, 1996

[54] SHOWER CURTAIN HAVING SELECTIVELY RAISABLE LOWER PORTION

[76] Inventor: Kim Logan, 17534 Margate Ave., Lathrup Village, Mich. 48076

[21] Appl. No.: 415,255

[22] Filed: Apr. 3, 1995

[51] Int. Cl.[6] ..... A47K 3/14

[52] U.S. Cl. ..... 4/558; 160/330; 160/349.1; 160/349.2; 160/DIG. 6; 4/608; 4/610

[58] Field of Search ..... 4/558, 608, 600, 4/610, 614; 160/84.01, 243, 330, 349.1, 349.2, DIG. 6

[56] References Cited

U.S. PATENT DOCUMENTS

| | | | |
|---|---|---|---|
| 1,003,763 | 9/1911 | Leo | 4/558 |
| 2,299,173 | 10/1942 | Pidgeon | 160/349.1 |
| 2,303,502 | 12/1942 | Rous | 4/608 |
| 2,481,397 | 9/1949 | Dalton, Jr. . | |
| 2,840,827 | 7/1958 | Calvano . | |
| 3,222,689 | 12/1965 | Efron et al. . | |
| 3,321,003 | 5/1967 | Boerner | 160/330 |
| 3,582,998 | 6/1971 | Morse . | |
| 3,965,960 | 6/1976 | Massey . | |
| 4,122,559 | 10/1978 | Kelly . | |
| 4,777,673 | 10/1988 | Patterson | 4/558 |
| 4,916,764 | 4/1990 | Meaden . | |
| 5,010,944 | 4/1991 | Bussert | 160/84.01 |
| 5,025,848 | 6/1991 | Procheska | 160/368.1 |
| 5,033,132 | 7/1991 | Greenblatt . | |
| 5,189,759 | 3/1993 | Poore | 4/558 |
| 5,231,708 | 8/1993 | Hansen . | |

*Primary Examiner*—Henry J. Recla
*Assistant Examiner*—Charles R. Eloshway
*Attorney, Agent, or Firm*—Peter D. Keefe

[57] ABSTRACT

A shower curtain which is slidable in relation to a suspension rod, and yet the lower portion thereof is selectively raisable for cleaning operations in and about the bathtub, as well as for other reasons such as for example aesthetic reasons. The selectively raisable shower curtain is composed of a flexible sheet of shower curtain material to which is affixed a plurality of rows of releasable fastener components. Each row is provided with a plurality of releasable fastener components, a predetermined spacing therebetween being provided. Accordingly, the shower curtain material may be raised to selected levels by being progressively folded horizontally and corresponding first and second components of the releasable fastener will hold the shower curtain in the at each raised level until the releasable fastener is released by a user. A shower curtain liner having the selectively raisable lower portion feature may be included.

12 Claims, 2 Drawing Sheets

SHOWER CURTAIN HAVING SELECTIVELY RAISABLE LOWER PORTION

BACKGROUND OF THE INVENTION

1. Field of the Invention

The present invention relates to shower curtains, and more particularly to a shower curtain which is provided with releasable fasteners that enable the lower portion thereof to be selectively raisable.

2. Description of the Related Art

Shower curtains provide a barrier for keeping shower water spray within the confines of a bathtub. Shower curtains are composed of a flexible sheet material which does not allow water penetration, such as for example a plastic sheet or a treated mildew resistant fabric. The shower curtain is suspended from a horizontally oriented suspension rod, wherein a plurality of regularly spaced hangers slidably engage the suspension rod and fixedly connect with a top end of the shower curtain at selected spaced locations therealong. Accordingly, the shower curtain can be slid relative to the suspension rod between two operative configurations: on one hand being horizontally spread-out along the suspension rod to thereby span the length of the bathtub, to, on the other hand, being horizontally compressed upon itself via appropriate sliding of the hangers along the suspension rod involving a flexing action along vertical pleats in the shower curtain which form between the hangers. While horizontal sliding of the shower curtain does afford easy ingress and egress for a shower-taker, it does not adequately get the shower curtain out of the way when the bathtub and its environs are being cleaned, or for other reasons, such as aesthetics.

In the art, some solutions to the problem of the shower curtain being in the way have been formulated, such as for example the disclosures contained in U.S. Pat. Nos. 2,481,397, 2,840,827, 3,222,689, 3,582,998, 3,965,960, 4,122,559, 5,231,708 and 5,033,132, which more or less generally disclose mounting a roll-up shower curtain in a manner not unlike that of a window shade.

What remains needed in the art, is a shower curtain which can slidably move along a suspension rod and thereby function like a conventional shower curtain, but which is further structured so that the lower portion thereof can be selectively raised toward the suspension rod for cleaning of the bathtub or for other reasons, such as aesthetics.

SUMMARY OF THE INVENTION

The present invention is a shower curtain which is slidable in relation to a suspension rod, and yet the lower portion thereof is selectively raisable for cleaning operations in and about the bathtub, as well as for other reasons such as for example aesthetic reasons.

The selectively raisable shower curtain according to the present invention is composed of a flexible sheet of shower curtain material to which is affixed a plurality of rows of releasable fastener components. Each row is provided with a plurality of releasable fastener components, a predetermined spacing therebetween being provided.

In the preferred embodiment of the selectively raisable shower curtain, the releasable fastener components are arranged in predetermined rows and columns. A first row of a first component of a releasable fastener is provided on a first side of the shower curtain material spaced a first distance from the bottom end thereof, which location is substantially adjacent thereto. A second row of the first component of the releasable fastener is provided on a second side of the shower curtain material spaced a second distance from the bottom end (the second distance being greater than the first distance). A first row of a second component of the releasable fastener is provided on the first side of the shower curtain material spaced a third distance from the bottom end (the third distance being greater than the second distance). And, finally, a second row of the second component of the releasable fastener is provided on the first side of the shower curtain material spaced a fourth distance from the bottom end (the fourth distance being greater than the third distance). The first and second fastener components of the releasable fastener are each arranged in columns (which are preferably coinciding) so that the respectively mating first and second fastener components of each row are spaced the same respective distance from the left and right side ends of the shower curtain material.

In operation of the preferred embodiment of the selectively raisable shower curtain, the shower curtain material is first horizontally folded along a first horizontal fold spaced a fifth distance from the bottom end (the fifth distance just exceeding the second distance). In this regard, each first component of the releasable fastener of the first row is caused to respectively engagingly mate with each second component of the releasable fastener of the third row. In operation further, the shower curtain material is secondly horizontally folded along a second horizontal fold spaced a sixth distance from the bottom end (the sixth distance exceeding the third distance by a small amount). In this regard, each first component of the releasable fastener of the second row is caused to respectively engagingly mate with each second component of the releasable fastener of the fourth row. The user selects the amount of raising of the lower portion of the selectively raisable shower curtain by determining whether to only provide the first horizontal folding or to proceed further to the second horizontal folding, depending on operations to be performed in the vicinity of the shower curtain, and/or for aesthetic, or other, reasons.

An accompanying shower curtain liner, where present, may also be equipped with the selectively raisable lower portion feature in the manner hereinabove recounted, but wherein it is preferred for selective raising to be by the horizontal folding of each of the shower curtain material and the shower curtain liner material to be in mutually opposite directions.

Accordingly, it is an object of the present invention to provide a shower curtain having a selectively raisable lower portion.

It is another object of the present invention to provide a shower curtain having a selectively raisable lower portion, which is slidably operable with respect to a suspension rod in the manner of a conventional shower curtain.

It is an additional object of the present invention to provide a selectively raisable shower curtain and selectively raisable shower curtain liner therefor, each of which being operable to slide along a suspension rod in the manner of a conventional shower curtain and shower curtain liner.

These, and additional objects, advantages, features and benefits of the present invention will become apparent from the following specification.

DETAILED DESCRIPTION OF THE PREFERRED EMBODIMENT

Figure 1:
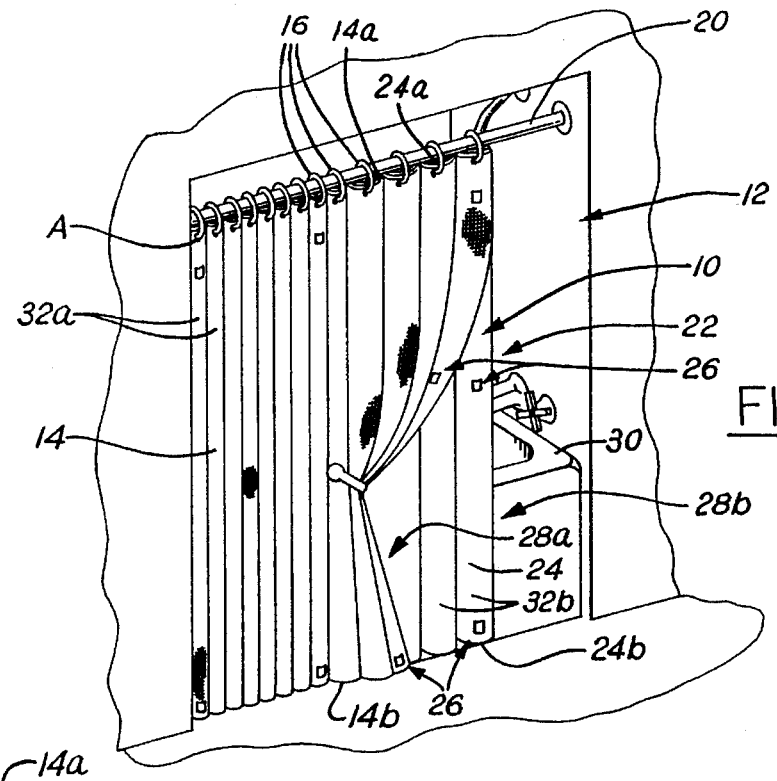
FIG. 1 is a perspective view of a selectively raisable shower curtain and selectively raisable shower curtain liner therefor, shown hanging in a typical bathroom setting.

Referring now to the Drawing, FIG. 1 depicts the selectively raisable shower curtain 10 according to the present invention in operation in a typical bathtub setting of a bathroom 12. The selectively raisable shower curtain 10 is composed of a water penetration resistant flexible sheet shower curtain material 14 of the sort well known in the building trades art, such as for example vinyl or a treated fabric. It will be noted that the selectively raisable shower curtain 10 is provided with a plurality of mutually spaced apart hangers 16 which are affixed to the top end 14*a* of the shower curtain material 14, such as for example by being passed through apertures A formed therein, and that the hangers provide a hooking or an encircling interaction with a suspension rod 20 (which is conventionally connected, at a horizontal attitude, to bathroom structures, such as the walls) so that the hangers are both suspended from the suspension rod and are slidable therealong.

It will be further noticed that a selectively raisable shower curtain liner 22 has been optionally also provided. The selectively raisable shower curtain liner 22 is composed of a water penetration resistant flexible sheet shower curtain liner material 24 of the sort well known in the building trades art, such as for example vinyl. The shower curtain liner material 24 has a top end 24*a* which connects with the hangers 16 in the manner of the aforesaid shower curtain material. Where present, the selectively raisable shower curtain liner 22 and the selectively raisable shower curtain 10 form a conventional synergism in which the selectively raisable shower curtain liner provides a primary water barrier and the selectively raisable shower curtain provides an attractive curtain-like look besides providing a secondary water barrier.

The selectively raisable shower curtain 10 and the selectively raisable shower curtain liner 22 can be slid relative to the suspension rod between two operative configurations: on one hand being horizontally spread-out along the suspension rod 20 to thereby span the length of the bathtub 30, to, on the other hand, being horizontally compressed upon themselves via appropriate sliding of the hangers along the suspension rod, involving a flexing action along vertical pleats 32*a*, 32*b* formed in the material respectively thereof between the hangers. Alternatively, of course, the selectively raisable shower curtain 10 and the selectively raisable shower curtain liner 22 may be suspended via separate sets of hangers from separate suspension rods.

Each of the selectively raisable shower curtain 10 and the selectively raisable shower curtain liner 22 are provided with a plurality of first and second components of a releasable fastener 26, whereby the lower portion 28*a*, 28*b* of each of the selectively raisable shower curtain and the selectively raisable shower curtain liner are selectively raisable, as will become clear from the hereinbelow detailed description, wherein reference is made additionally to remaining FIGS. 2 through 8.

FIGS. 2 through 5 depict a typical preferred arrangement for the first and second components of a releasable fastener 26. Since each of the selectively raisable shower curtain 10 and the selectively raisable shower curtain liner 22 are composed of flexible sheet material 14, 24 and are each provided similarly with first and second components of a releasable fastener 26, the description pertaining to FIGS. 2 through 5 applies to either, although for the sake of simplicity, the term "selectively raisable shower curtain" (and its associated terminology) will be used and yet actually refer equally to each of the selectively raisable shower curtain material and the selectively raisable shower curtain liner material.

In the preferred embodiment of the selectively raisable shower curtain 10, the releasable fastener 26 has a first component 26*a* and a second component 26*b* which are mutually matable and thereby engagingly interconnectable. Examples of acceptable releasable fasteners 26 having first and second components 26*a*, 26*b* are hook and loop fasteners and snap fasteners; other kinds of releasable fasteners may also be utilized. The first and second components 26*a*, 26*b* are arranged in predetermined rows and columns on the first and second sides 141, 142 of the shower curtain material 14.

Figure 2:
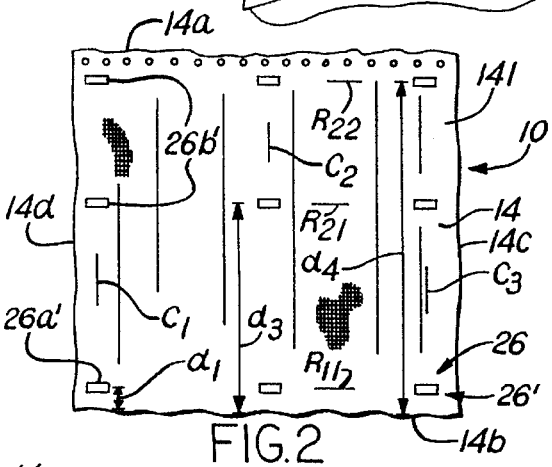
FIG. 2 is an elevational view of a first side of the selectively raisable shower curtain, wherein a first example of releasable fastener is depicted.
Figure 3:
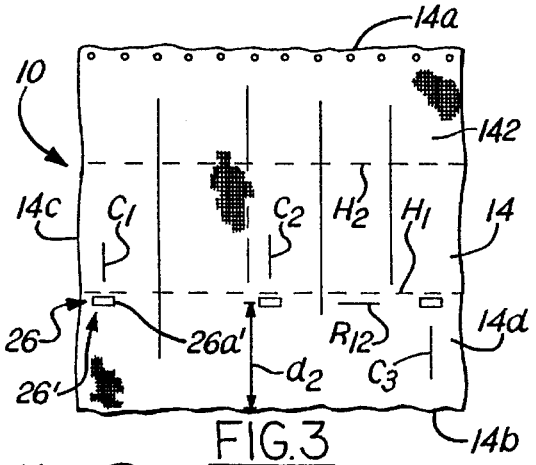
FIG. 3 is an elevational view of a second side of the selectively raisable shower curtain, wherein the first example of releasable fastener is depicted.

As depicted by way of example in FIGS. 2 and 3, a first row $R_{11}$ of a first component 26*a'* of a releasable fastener 26', which is depicted as a VELCRO (trademark Velcro, USA) type hook and loop fastener (wherein one of the hook and loop components is the first component 26*a'* and the other of the hook and loop components is the second component 26*b'*), is provided on a first side 141 of the shower curtain material 14 spaced a first distance $d_1$ from the bottom end thereof 14*b*, which location is substantially adjacent thereto. A second row $R_{12}$ of the first component 26*a'* of the releasable fastener 26' is provided on a second side 142 of the shower curtain material 14 spaced a second distance $d_2$ from the bottom end 14*b* (the second distance being greater than the first distance). A first row $R_{21}$ of a second component 26*b'* of the releasable fastener 26' is provided on the first side 141 of the shower curtain material 14 spaced a third distance $d_3$ from the bottom end 14*b* (the third distance being greater than the second distance). And, finally, a second row $R_{22}$ of the second component 26*b'* of the releasable fastener 26' is provided on the first side 141 of the shower curtain material 14 spaced a fourth distance $d_4$ from the bottom end 14*b* (the fourth distance being greater than the third distance), which location is substantially adjacent the top end 14*a*. The first and second fastener components 26*a'*, 26*b'* of the releasable fastener 26' are each arranged in columns $C_1$, $C_2$, $C_3$, so that the respectively mating first and second fastener components of each row are spaced the same respective distance from the left and right side ends 14*c*, 14*d* of the shower curtain material 14. Of course, it does not mechanically matter whether the rows have a particular one of the first and second components 26*a'*, 26*b'*, so long as row $R_{11}$ and row $R_{21}$ are different and row $R_{12}$ and row $R_{22}$ are different so as to allow for mated engagement respectively therebetween.

Figure 4:
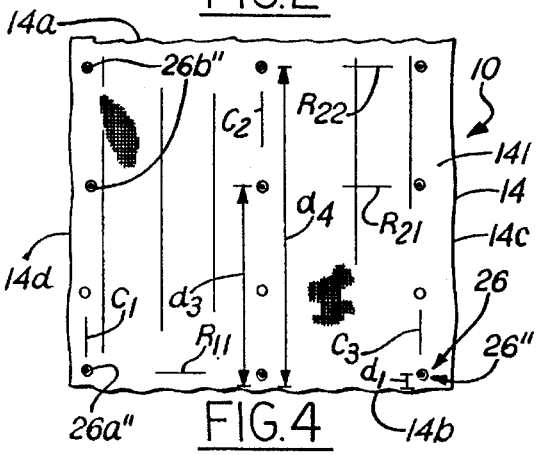
FIG. 4 is an elevational view of a first side of the selectively raisable shower curtain, wherein a second example of releasable fastener is depicted.
Figure 5:
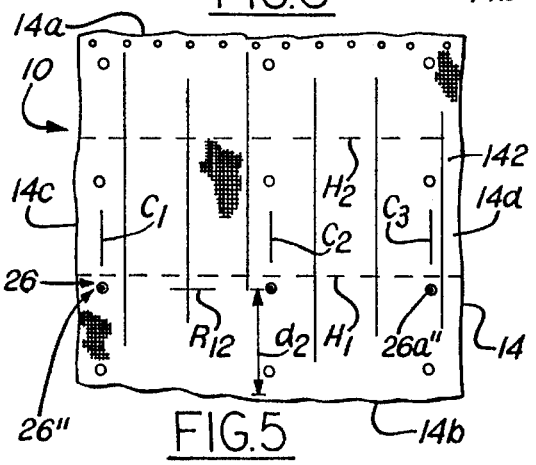
FIG. 5 is an elevational view of a second side of the selectively raisable shower curtain, wherein the second example of releasable fastener is depicted.

As similarly depicted by way of example in FIGS. 4 and 5, a first row $R_{11}$ of a first component 26*a"* of a releasable fastener 26", which is depicted as a snap type releasable fastener (wherein one of the male and female components thereof is the first component 26*a"* and the other of the male and female components is the second component 26*b"*), is provided on a first side 141 of the shower curtain material 14 spaced a first distance $d_1$ from the bottom end thereof 14*b*. A second row $R_{12}$ of the first component 26*a"* of the releasable fastener 26" is provided on a second side 142 of the shower curtain material 14 spaced a second distance $d_2$ from the bottom end 14*b*. A first row $R_{21}$ of a second component 26*b"* of the releasable fastener 26" is provided on the first side 141 of the shower curtain material 14 spaced a third distance $d_3$ from the bottom end 14*b*. And, finally, a second row $R_{22}$ of the second component 26*b"* of the releasable fastener 26" is provided on the first side 141 of the shower curtain material 14 spaced a fourth distance $d_4$ from the bottom end 14*b*, which location is substantially adjacent the top end 14*a*. The first and second fastener components 26*a"*, 26*b"* of the releasable fastener 26" are each arranged in columns $C_1$, $C_2$, $C_3$, so that the respectively mating first and second fastener components of each row are spaced the same respective distance from the left and right side ends 14*c*, 14*d* of the shower curtain material 14. Of course, it does not mechanically matter whether the rows have a particular one of the first and second components 26*a"*, 26*b"*, so long as row $R_{11}$ and row $R_{21}$ are different and row $R_{12}$ and row $R_{22}$ are different so as to allow for mated engagement respectively therebetween.

It should be noted that although a hook and loop type releasable fastener and a snap type releasable fastener have been described, these are merely for preferred exemplary purposes and not to be taken as exclusionary. Any number of suitable releasable fasteners may be known to those of ordinary skill in the art, and such substitutions are considered within the expository intent of the present disclosure.

Now, when a selectively raisable shower curtain liner 22 is present, it is placed side-by-side with the selectively raisable shower curtain 10, wherein the first side of each 141, 241 faces mutually away from the other (or, in other words, the second side 142, 242 of each faces mutually toward the other).

Figure 6:
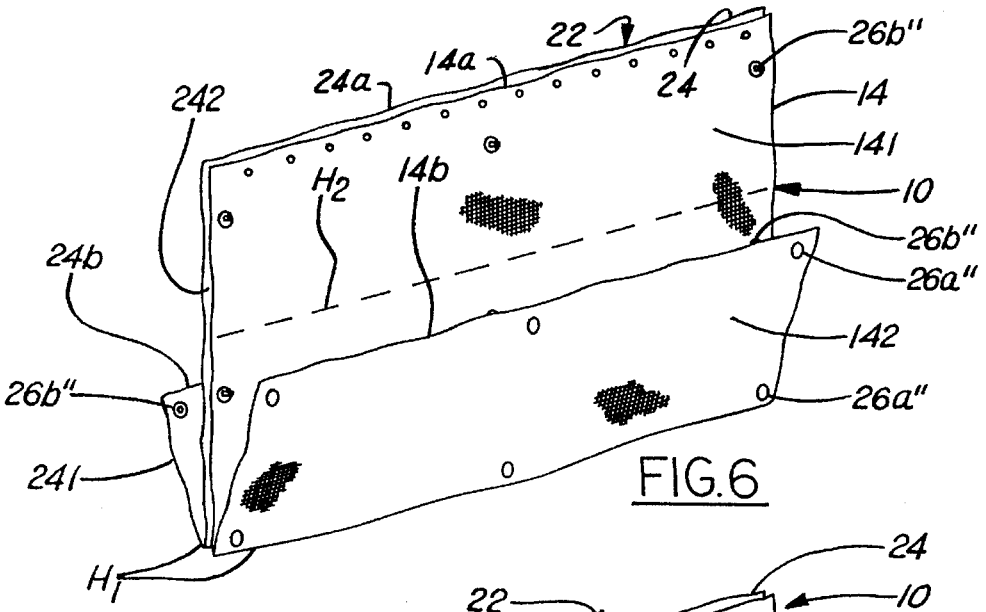
FIG. 6 is a perspective view of the selectively raisable shower curtain and selectively raisable shower curtain liner being each first horizontally folded to thereby provide a first raising of the lower portion of each, respectively.
Figure 7:
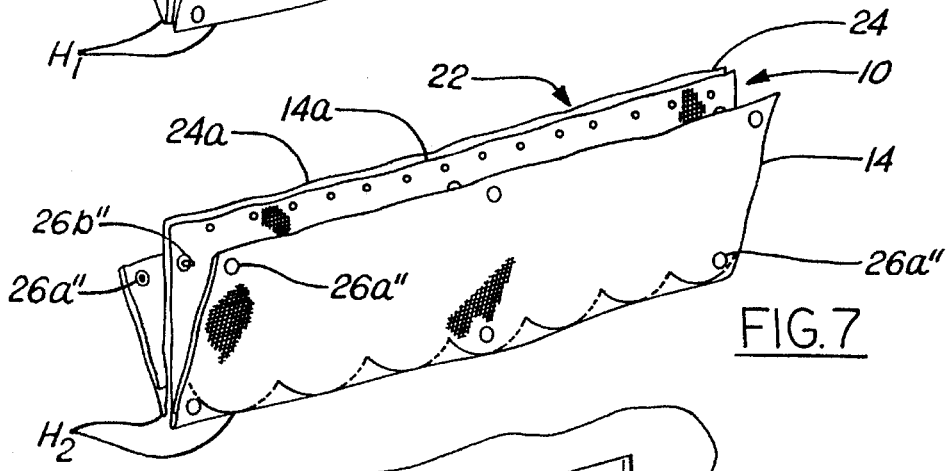
FIG. 7 is a perspective view of the selectively raisable shower curtain and selectively raisable shower curtain liner being each second horizontally folded to thereby provide a second raising of the lower portion of each, respectively.

FIGS. 6 and 7 depict a preferred example of raising operations of the selectively raisable shower curtain 10 and the selectively raisable shower curtain liner 22 therefor.

As shown in FIG. 6, a first raised level is achieved by each of the shower curtain material 14 and the shower curtain liner material 24 being first horizontally folded (in mutually opposing directions) along a horizontal fold $H_1$ spaced a fifth distance $d_5$ from the respective bottom end 14*b*, 24*b* (the fifth distance just exceeding the aforementioned second distance). In this regard with reference to FIGS. 2 through 5, each first component of the releasable fastener of the first row $R_{11}$ is caused to respectively engagingly mate with each second component of the releasable fastener of the third row $R_{21}$.

As shown in FIG. 7, a second raised level is achieved by each of the shower curtain material 14 and the shower curtain liner material 24 being secondly horizontally folded along a second horizontal fold $H_2$ spaced a sixth distance $d_6$ from the respective bottom end 14*b*, 24*b* (the sixth distance exceeding the aforementioned third distance). In this regard with reference to FIGS. 2 through 5, each first component of the releasable fastener of the second row $R_{12}$ is caused to respectively engagingly mate with each second component of the releasable fastener of the fourth row $R_{22}$.

In operation, the user selects the level of raising of the lower portion of the selectively raisable shower curtain by determining whether to only provide the first horizontal folding or to proceed further to the second horizontal folding, depending on operations to be performed in the vicinity of the shower curtain, and/or for aesthetic, or other, reasons.

Of course, additional or fewer levels of folding may be supplied by appropriate addition or subtraction of rows of the first and second components of the releasable fastener. Further, the number of columns of components may be varied to balance the need for a secure and tidy look, yet limit the number of requested interconnection manipulations. Indeed, of course, the coinciding columns of components of one mating set of rows may not necessarily be that of another mating set of rows, although for the sake of balance this is desirable.

Figure 8:
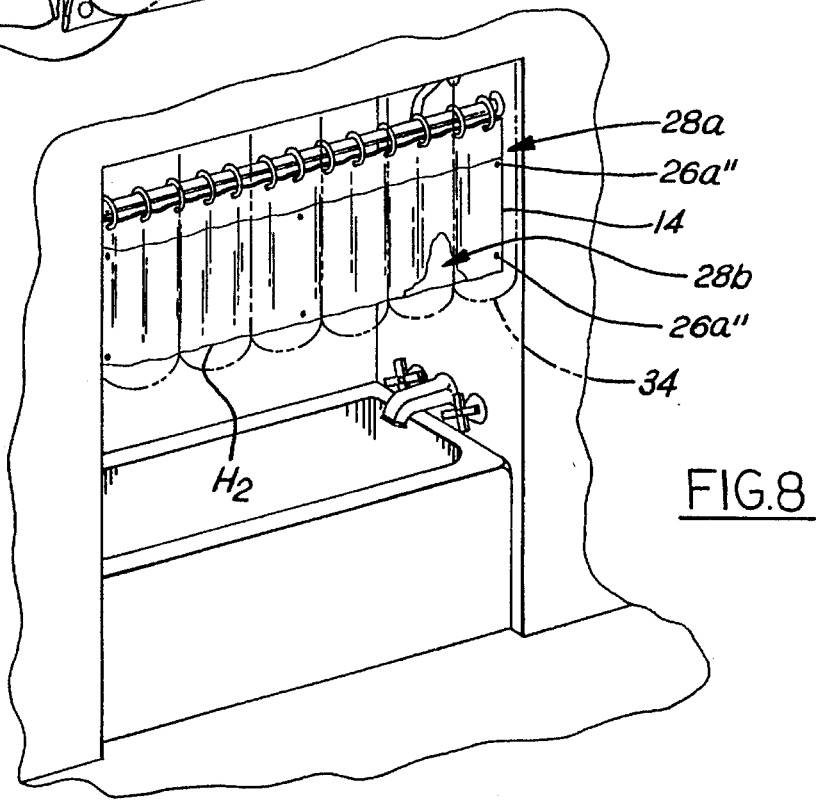
FIG. 8 is a perspective view of the selectively raisable shower curtain and selectively raisable shower curtain liner therefor shown in FIG. 1, now provided with first and second horizontal folds to thereby provide a second raising of the lower portion of each, respectively.

FIG. 8 depicts the selectively raisable shower curtain 10 and the selectively raisable shower curtain liner 22 of FIG. 1 raised to the second level by performing the operations thereupon as outlined hereinabove with respect to FIGS. 6 and 7. The selectively raisable shower curtain 10 and the selectively raisable shower curtain liner 22 (where present) may be returned to the configuration of FIG. 1 by simply unfastening the first and second components of the releasable fastener, performed in reverse of the steps outlined hereinabove, and letting gravity remove the horizontal folds.

A valence 34 (shown in phantom in FIG. 8) may be located adjacent the top end 14*a*, 24*a* to cosmetically cover the depending top portions 28*a'* 28*b'* of the selectively raisable shower curtain 10 and the selectively raisable shower curtain liner 22, if desired. Or, if desired, the pattern of the selectively raisable shower curtain 10 may include a valencing look (see phantom lines in FIG. 7) when in the second raising level configuration depicted in FIG. 8. In this regard, it is desirable for the pattern on the shower curtain material 14 and the pattern of the shower curtain liner material 24 and the look of the first and second components of the releasable fastener 26 to visually pleasingly cooperate and/or otherwise render an unobtrusive and pleasing overall appearance.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A shower curtain having a selectively raisable lower portion comprising:

a flexible shower curtain material having a top end and an opposite bottom end, a right side end and an opposite left side end, and a first side and an opposite second side;

releasable fastener means connected with said material for releasably retaining said material in at least one raised level configuration, said releasable fastener means comprising first and second components that are mutually releasably engaged when respectively mated;

a plurality of one of said first and second components arranged on said first side of said material in a first row located a first predetermined distance from said bottom end;

a plurality of the other of said first and second components arranged on said first side of said material in a second row located a second predetermined distance from said bottom end, wherein said second distance exceeds said first distance;

wherein each of said first and second components of said first and second rows are serially spaced along each of said first and second rows in a series of coinciding first columns;

wherein said material is first folded along a first horizontal fold located a third predetermined distance from said bottom end so that said components of said first row are matable with respective said components of said second row;

a plurality of one of said first and second components arranged on said second side of said material in a third row located a fourth predetermined distance from said bottom end;

a plurality of the other of said first and second components arranged on said first side of said material in a fourth row located a fifth predetermined distance from said bottom end, wherein said fifth distance exceeds said fourth distance;

wherein each of said first and second components of said third and fourth rows are serially spaced along each of said third and fourth rows in a series of coinciding second columns; and, wherein said material after being said first folded, is second folded along a second horizontal fold located a sixth predetermined distance from said bottom end so that said third row coincides with said fourth row, whereupon said components of said fourth row are matable with respective said components of said fifth row.

2. The shower curtain of claim 1, wherein said first row is located substantially adjacent said bottom end of said material.

3. The shower curtain of claim 2, wherein said said third predetermined distance exceeds said fourth predetermined distance, and said third row is located substantially adjacent said first horizontal fold.

4. The shower curtain of claim 3, wherein said fourth row is located substantially adjacent said top end of said material.

5. The shower curtain of claim 4, wherein said first and second columns mutually coincide.

6. A shower curtain liner having a selectively raisable lower portion comprising:

a flexible shower curtain liner material having a top end and an opposite bottom end, a right side end and an opposite left side end, and a first side and an opposite second side;

releasable fastener means connected with said material for releasably retaining said material in at least one raised level configuration, said releasable fastener means comprising first and second components that are mutually releasably engaged when respectively mated;

a plurality of one of said first and second components arranged on said first side of said material in a first row located a first predetermined distance from said bottom end;

a plurality of the other of said first and second components arranged on said first side of said material in a second row located a second predetermined distance from said bottom end, wherein said second distance exceeds said first distance;

wherein each of said first and second components of said first and second rows are serially spaced along each of said first and second rows in a series of coinciding first columns;

wherein said material is first folded along a first horizontal fold located a third predetermined distance from said bottom end so that said components of said first row are matable with respective said components of said second row;

a plurality of one of said first and second components arranged on said second side of said material in a third row located a fourth predetermined distance from said bottom end;

a plurality of the other of said first and second components arranged on said first side of said material in a fourth row located a fifth predetermined distance from said bottom end, wherein said fifth distance exceeds said fourth distance;

wherein each of said first and second components of said third and fourth rows are serially spaced along each of said third and fourth rows in a series of coinciding second columns; and, wherein said material after being said first folded, is second folded along a second horizontal fold located a sixth predetermined distance from said bottom end so that said third row coincides with said fourth row, whereupon said components of said fourth row are matable with respective said components of said fifth row.

7. The shower curtain liner of claim 6, wherein said first row is located substantially adjacent said bottom end of said material.

8. The shower curtain liner of claim 7, wherein said said third predetermined distance exceeds said fourth predetermined distance, and said third row is located substantially adjacent said first horizontal fold.

9. The shower curtain liner of claim 8, wherein said fourth row is located substantially adjacent said top end of said material.

10. The shower curtain liner of claim 9, wherein said first and second columns mutually coincide.

11. A combination shower curtain having a selectively raisable lower portion and shower curtain liner therefor having a selectively raisable lower portion, said combination comprising:

a flexible shower curtain material having a top end and an opposite bottom end, a right side end and an opposite left side end, and a first side and an opposite second side;

first releasable fastener means connected with said shower curtain material for releasably retaining said shower curtain material in at least one raised level configuration thereof;

a flexible shower curtain liner material having a top end and an opposite bottom end, a right side end and an opposite left side end, and a first side and an opposite second side; and second releasable fastener means connected with said shower curtain liner material for releasably retaining said shower curtain liner material in at least one raised level configuration thereof;

wherein said second side of said shower curtain material faces generally toward said second side of said shower curtain liner material;

wherein said at least one raised level configuration of said shower curtain material comprises said shower curtain material being at least once folded along at least one horizontal shower curtain material fold, wherein said at least one horizontal shower curtain fold is located between said top and bottom ends of said shower curtain material, is oriented substantially parallel with respect thereto and extends between said right and left side ends of said shower curtain material;

wherein said at least one raised level configuration of said shower curtain liner material comprises said shower curtain liner material being at least once folded along at least one horizontal shower curtain liner material fold, wherein said at least one horizontal shower curtain liner fold is located between said top and bottom ends of said shower curtain liner material, is oriented substantially parallel with respect thereto and extends between said right and left side ends of said shower curtain liner material; and wherein said at least one horizontal shower curtain fold is folded mutually opposite said at least one horizontal shower curtain liner fold, such that said shower curtain material folds away from said shower curtain liner material and said shower curtain liner material folds away from said shower curtain material.

12. The combination of claim 11, wherein said first releasable fastener means further comprises said first and second components thereof being distributed on at least one of said first and second sides of said shower curtain material in a first predetermined pattern of rows and columns, wherein selected said first components mate with respective selected said second components when said shower curtain material is at least once folded; and wherein said second releasable fastener means further comprises said first and second components thereof being distributed on at least one of said first and second sides of said shower curtain liner material in a second predetermined pattern of rows and columns, wherein selected said first components mate with respective selected said second components when said shower curtain liner material is at least once folded.

* * * * *